US005198097A

United States Patent [19]

Bogdan et al.

[11] Patent Number: 5,198,097

[45] Date of Patent: Mar. 30, 1993

[54] REFORMULATED-GASOLINE PRODUCTION

[75] Inventors: Paula L. Bogdan, Des Plaines; R. Joe Lawson, Palatine; J. W. Adriaan Sachtler, Des Plaines, all of Ill.

[73] Assignee: UOP, Des Plaines, Ill.

[21] Appl. No.: 796,101

[22] Filed: Nov. 21, 1991

[51] Int. Cl.[5] ..... C10G 59/00; C10G 59/06

[52] U.S. Cl. ..... 208/79; 208/78; 208/80; 208/93; 208/133; 585/302; 585/304

[58] Field of Search ..... 208/78, 79, 80; 585/302, 304

[56] References Cited

U.S. PATENT DOCUMENTS

| | | | |
|---|---|---|---|
| 3,788,975 | 12/1974 | Donaldson | 208/60 |
| 3,933,619 | 1/1976 | Kozlowski | 208/60 |
| 4,125,566 | 11/1978 | Trin Dinh et al. | 208/79 |
| 4,162,212 | 7/1979 | Miller | 585/302 |
| 4,181,599 | 1/1980 | Miller et al. | 208/80 |
| 4,209,383 | 6/1980 | Herout et al. | 208/93 |
| 4,647,368 | 3/1987 | McGuiness et al. | 208/60 |
| 4,969,987 | 11/1990 | Le et al. | 208/67 |
| 5,100,534 | 3/1992 | Le et al. | 208/79 |

*Primary Examiner*—Helane M. Myers

*Attorney, Agent, or Firm*—Thomas K. McBride; John F. Spears, Jr.; Richard E. Conser

[57] ABSTRACT

A process combination is disclosed to reduce the aromatics content and increase the oxygen content of a key component of gasoline blends. A naphtha feedstock having a boiling range usually suitable as catalytic-reforming feed is processed by selective isoparaffin synthesis to yield lower-molecular weight hydrocarbons including a high yield of isobutane. A portion of the isobutane is processed to yield an ether component by dehydrogenation to yield isobutene followed by etherification. Part of the isobutane and isobutene are alkylated to produce an alkylate component. The synthesis light naphtha may be upgraded by isomerization. The heavier portion of the synthesis naphtha is processed in a reformer. A gasoline component containing oxygen as ether and having a reduced aromatics content and increased volumetric yield relative to reformate of the same octane number is blended from the net products of the above processing steps.

19 Claims, 1 Drawing Sheet

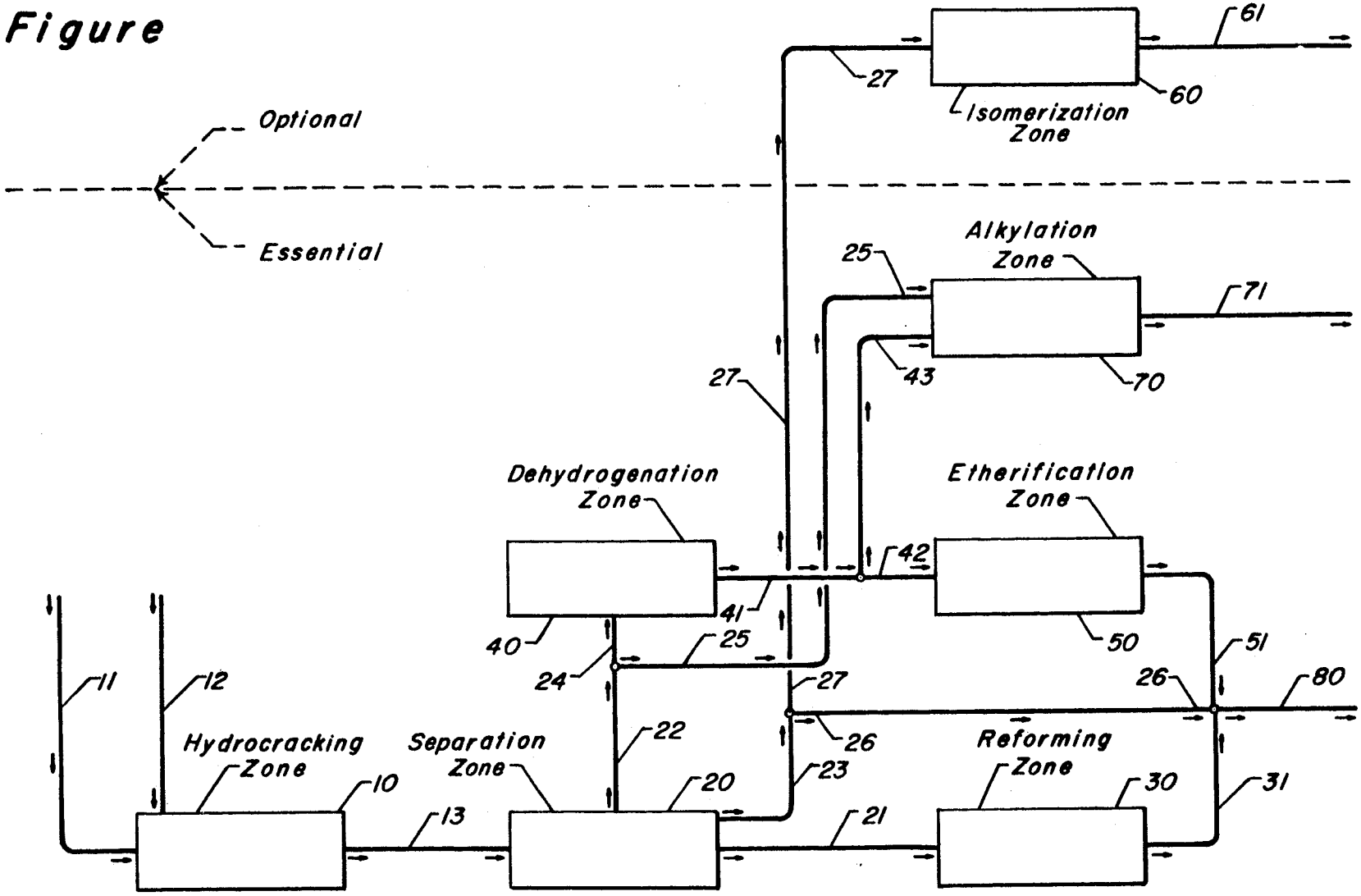
Figure

REFORMULATED-GASOLINE PRODUCTION

BACKGROUND OF THE INVENTION

1. Field of the Invention

This invention relates to an improved process combination for the conversion of hydrocarbons, and more specifically for the upgrading of a naphtha stream by a combination of selective isoparaffin synthesis, etherification of light products, alkylation and reforming.

2. General Background

The widespread removal of lead antiknock additive from gasoline and the rising fuel-quality demands of high-performance internal-combustion engines have compelled petroleum refiners to install new and modified processes for increased "octane," or knock resistance, in the gasoline pool. Refiners have relied on a variety of options to upgrade the gasoline pool, including higher-severity catalytic reforming, higher FCC (fluid catalytic cracking) gasoline octane, isomerization of light naphtha and the use of oxygenated compounds. Such key options as increased reforming severity and higher FCC gasoline octane result in a higher aromatics content of the gasoline pool, through the production of high-octane aromatics at the expense of low-octane heavy paraffins. Current gasolines generally have aromatics contents of about 30% or higher, and may contain more than 40% aromatics.

Currently, refiners are faced with the prospect of supplying reformulated gasoline to meet tightened automotive emission standards. Reformulated gasoline would differ from the existing product in having a lower vapor pressure, lower final boiling point, increased content of oxygenates, and lower content of olefins, benzene and aromatics. The oxygen content of gasoline will be 2% or more in many areas. cor:tent Gasoline aromatics content is likely to be lowered into the 20–25% range in major urban areas, and low-emission gasoline containing less than 15% aromatics is being advocated for some areas with severe pollution problems.

Since aromatics have been the principal source of increased gasoline octanes during the recent lead-reduction program, severe restriction of the aromatics content will present refiners with processing problems. Currently applicable technology includes such processes as recycle isomerization of light naphtha and generation of additional light olefins through fluid catalytic cracking and isobutane through isomerization as feedstock to an alkylation unit. Increased blending of oxygenates such as methyl tertiary-butyl ether (MTBE) and ethanol will be an essential part of the reformulated-gasoline program, but feedstock supplies will become stretched. Novel processing technology is needed to support an effective program.

RELATED ART

Process combinations for the upgrading of naphtha to yield gasoline are known in the art. These combine known and novel processing steps primarily to increase gasoline octane, generally by producing and/or recovering aromatics needed to compensate for lead-antiknock removal from gasoline over a period of about 15 years.

U.S. Pat. No. 3,788,975 (Donaldson) teaches a combination process for the production of aromatics and isobutane using an "I-cracking" reaction zone followed by a combination of processes including catalytic reforming, aromatic separation, alkylation, isomerization, and dehydrogenation to yield alkylation feedstock. The paraffinic stream from aromatic extraction is returned to the cracking step. The gasoline pool is made up of isomerized product, aromatics and optionally alkylate. Donaldson does not disclose the present process combination, however. Even with the paraffinic alkylate in the gasoline pool, aromatics content is a high 38 volume % and the scheme of Donaldson would not achieve the present reduction in aromatics content at constant gasoline-product octane number.

A combination process including hydrocracking for gasoline production is disclosed in U.S. Pat. No. 3,933,619 (Kozlowski). High-octane, low-lead or unleaded gasoline is produced by hydrocracking a hydrocarbon feedstock to obtain butane, pentane-hexane, and $C_7$+ hydrocarbons. Alternative embodiments are disclosed for upgrading pentanes and hexanes, and the $C_7$+ fraction may be sent to a reformer along with cyclohexane from isomerization of hydrocracked $C_6$ to yield an aromatics-rich product. The present process combination is not disclosed in Kozlowski, however, nor would it achieve the present reduction in aromatics content at constant octane number of the gasoline product.

U.S. Pat. No. 4,209,383 (Herout et al.) teaches a process combination for benzene reduction using catalytic reforming, catalytic cracking and alkylation of cracked light olefins with aromatics in the reformate. This scheme does not suggest the present process combination nor does it result in an overall reduction in gasoline aromatics content.

U.S. Pat. No. 4,647,368 (McGuiness et al.) discloses a method for upgrading naphtha by hydrocracking over zeolite beta, recovering isobutane, $C_5$–$C_7$ isoparaffins and a higher boiling stream, and reforming the latter stream. The reference neither teaches all the elements of nor suggests the present process combination, however.

The prior art, therefore, contains elements of the present invention. There is no suggestion to combine the elements, however, nor of the surprising benefits that accrue from the present process combination to produce a gasoline component for reformulated gasoline.

SUMMARY OF THE INVENTION

It is an object of the present invention to provide an improved process combination to upgrade naphtha to gasoline. A specific object is to produce high-octane gasoline having a reduced content of aromatics. A more specific object is to obtain a high-octane gasoline component having an increased oxygen content and reduced aromatics content.

This invention is based on the discovery that a combination of selective isoparaffin synthesis, isobutane dehydrogenation, etherification, alkylation and catalytic reforming can yield a gasoline component having reduced aromatics and increased oxygen content that may be required in future formulations. The reforming unit operates at lower severities than currently required, preserving heavier paraffins in the product which are supplemented by paraffins derived by selective isoparaffin synthesis, isomerization and/or alkylation to obtain gasoline of increased paraffinicity.

A broad embodiment of the present invention is directed to a process combination comprising selectively synthesizing isoparaffins from a naphtha feedstock, dehydrogenating a portion of the isobutane obtained from selective isoparaffin synthesis and etherifying a portion of the resulting isobutene, alkylating a second portion of each of the isobutane and isobutene, reforming synthesis naphtha and blending the resulting products to obtain a gasoline component. In a preferred embodiment, all of the isobutane from selective isoparaffin synthesis is either dehydrogenated or alkylated and all of the isobutene from dehydrogenation is either etherified or alkylated. Preferably the process combination is installed in a petroleum refinery comprising other process units to produce finished petroleum products.

Light naphtha from selective isoparaffin synthesis is isomerized, in a alternative embodiment, to further upgrade the gasoline component. Optionally, reformate from the catalytic reforming of synthesis naphtha may be separated to obtain light reformate as an additional isomerization feedstock.

These as well as other objects and embodiments will become apparent from the detailed description of the invention.

BRIEF DESCRIPTION OF THE DRAWING

The FIGURE represents a simplified block flow diagram showing the arrangement of the major sections of the present invention.

DESCRIPTION OF THE PREFERRED EMBODIMENTS

To reiterate, a broad embodiment of the present invention is directed to a process combination comprising selectively synthesizing isoparaffins from a naphtha feedstock, dehydrogenating a portion of the isobutane obtained from selective isoparaffin synthesis and etherifying a portion of the resulting isobutene, alkylating a second portion of each of the isobutane and isobutene, reforming synthesis naphtha and blending the resulting products to obtain a gasoline component. Usually the process combination is integrated into a petroleum refinery comprising crude-oil distillation, reforming, cracking and other processes known in the art to produce finished gasoline and other petroleum products.

The naphtha feedstock to the present process combination will comprise paraffins and naphthenes, and may comprise aromatics and small amounts of olefins, boiling within the gasoline range. Feedstocks which may be utilized include straight-run naphthas, natural gasoline, synthetic naphthas, thermal gasoline, catalytically cracked gasoline, partially reformed naphthas or raffinates from extraction of aromatics. The distillation range may be that of a full-range naphtha, having an initial boiling point typically from 40°-80° C. and a final boiling point of from about 160°-230° C., or it may represent a narrower range. Preferably the naphtha feedstock is relatively high-boiling and contains heavy components not usually found in feed to a catalytic reforming process unit. A high-boiling naphtha feedstock is converted in the selective isoparaffin synthesis step to obtain a lower-boiling reforming feed, thereby converting a greater proportion of naphtha into gasoline than if the feedstock were processed by catalytic reforming without selective isoparaffin synthesis.

The naphtha feedstock generally contains small amounts of sulfur compounds amounting to less than 10 parts per million (ppm) on an elemental basis. Preferably the hydrocarbon feedstock has been prepared from a contaminated feedstock by a conventional pretreating step such as hydrotreating, hydrorefining or hydrodesulfurization to convert such contaminants as sulfurous, nitrogenous and oxygenated compounds to $H_2S$, $NH_3$ and $H_2O$, respectively, which can be separated from the hydrocarbons by fractionation. This conversion preferably will employ a catalyst known to the art comprising an inorganic oxide support and metals selected from Groups VIB(6) and VIII(9-10) of the Periodic Table. [See Cotton and Wilkinson, *Advanced Organic Chemistry*, John Wiley & Sons (Fifth Edition, 1988)]. Preferably, the pretreating step will provide the selective isoparaffin-synthesis process with a hydrocarbon feedstock having low sulfur levels disclosed in the prior art as desirable, e.g., 1 ppm to 0.1 ppm (100 ppb). It is within the ambit of the present invention that this optional pretreating step be included in the present reforming process.

The broad and preferred embodiments of the present invention are optimally understood by reference to the FIGURE. The process combination comprises a selective-isoparaffin-synthesis zone 10, separation zone 20, reforming zone 30, dehydrogenation zone 40, etherification zone 50, alkylation zone 60 and optional isomerization zone 70. For clarity, only the major sections and interconnections of the process combination are shown. Individual equipment items such as reactors, heaters, heat exchangers, separators, fractionators, pumps, compressors and instruments are well known to the skilled routineer; description of this equipment is not necessary for an understanding of the invention or its underlying concepts. Operating conditions, catalysts, design features and feed and product relationships are discussed hereinbelow.

The naphtha feedstock is introduced into selective-isoparaffin-synthesis zone 10 through line 11. This zone contains an active, selective isoparaffin-synthesis catalyst which permits operating pressures and temperatures to be used which are significantly below those employed in conventional hydrocracking. Heavier components of the naphtha are converted and paraffins are isomerized, in the presence of hydrogen introduced through line 12, with minimum formation of light hydrocarbon gases such as methane and ethane. Side chains are cracked from heavier cyclic compounds while retaining the cyclic rings. Heavy paraffins are converted to yield a high proportion of isobutane, useful for production of alkylate or ethers for gasoline blending. Lighter paraffins such as pentanes and hexanes are formed in the process with a high proportion of higher-octane branched-chain isomers, with an isopentane/normal-pentane ratio in excess of that which usually would be obtained by pentane isomerization. The overall effect is that the molecular weight and final boiling point of the hydrocarbons are reduced, naphthenic rings are substantially retained, and the content of isoparaffins is increased significantly in the effluent from selective isoparaffin synthesis relative to the naphtha feedstock. The synthesis effluent passes through line 13 to a separation zone 20.

Selective-isoparaffin-synthesis operating conditions will vary according to the characteristics of the feedstock and the product objectives. Operating pressure may range between about 10 atmospheres and 100 atmospheres gauge, and preferably between about 20 and 70 atmospheres. Temperature is selected to balance conversion, which is promoted by higher temperatures, against favorable isomerization equilibrium and product selectivity which are favored by lower temperatures; operating temperature generally is between about 50° and 350° C. and preferably between 100° C. and 300° C. Catalyst is loaded into the reactors of the selective isoparaffin-synthesis process to provide a liquid hourly space velocity of between about 0.5 and 20, and more usually between about 1.0 and 10.

Hydrogen is supplied to the reactors of the selective isoparaffin-synthesis zone not only to provide for hydrogen consumed in conversion, saturation and other reactions but also to maintain catalyst stability. The hydrogen may be partially or totally supplied from outside the process, and a substantial proportion of the requirement may be provided by hydrogen recycled after separation from the reactor effluent. The ratio of hydrogen to naphtha feedstock ranges usually from about 1.0 to 10. In an alternative embodiment, the hydrogen-to-hydrocarbon mole ratio in the reactor effluent is about 0.05 or less; this obviates the need to recycle hydrogen from the reactor effluent to the feed.

In a preferred embodiment, the naphtha feedstock passes to an aromatics-hydrogenation reactor prior to contacting the selective isoparaffin-synthesis catalyst in the selective-isoparaffin-synthesis zone. It is especially preferred that the aromatics-hydrogenation reactor be contained within the selective-isoparaffin-synthesis zone after introduction of hydrogen and that effluent from aromatics hydrogenation contacts the selective isoparaffin-synthesis catalyst without separation of the hydrogen. An aromatics-saturation catalyst in the reactor contains at least one Group VIII (8–10) metal on an inorganic-oxide support, and may contain one or more modifiers from Groups VIB (6) and IVA (14). Suitable operating conditions include temperatures of from about 30° to 120° C., liquid hourly space velocities of from about 1 to 8, and pressures as specified above for selective isoparaffin synthesis. Hydrogen requirements are about 0.1 to 10 moles per mole of naphtha feedstock, or preferably as required for the subsequent selective isoparaffin-synthesis catalyst. Most preferably, an exothermic heat of reaction resulting from aromatics saturation results in no heating requirement between the aromatics-saturation and the selective isoparaffin-synthesis catalyst in the selective-isoparaffin-synthesis zone.

The selective isoparaffin-synthesis catalyst generally comprises an acid component, for example a halide such as aluminum chloride and/or a zeolite such as mordenite. Preferably the catalyst contains an inorganic-oxide binder, a Friedel-Crafts metal halide and a Group VIII (8–10) metal component. Optimal and alternative embodiments are described below.

The refractory inorganic-oxide support optimally is a porous, adsorptive, high-surface-area support having a surface area of about 25 to about 500 $m^2/g$. The porous carrier material should also be uniform in composition and relatively refractory to the conditions utilized in the process. By the term "uniform in composition," it is meant that the support be unlayered, has no concentration gradients of the species inherent to its composition, and is completely homogeneous in composition. Thus, if the support is a mixture of two or more refractory materials, the relative amounts of these materials will be constant and uniform throughout the entire support. It is intended to include within the scope of the present invention carrier materials which have traditionally been utilized in dual-function hydrocarbon conversion catalysts such as: (1) refractory inorganic oxides such as alumina, titania, zirconia, chromia, zinc oxide, magnesia, thoria, boria, silica-alumina, silica-magnesia, chromia-alumina, alumina-boria, silica-zirconia, etc.; (2) ceramics, porcelain, bauxite; (3) silica or silica gel, silicon carbide, clays and silicates including those synthetically prepared and naturally occurring, which may or may not be acid treated, for example attapulgus clay, diatomaceous earth, fuller's earth, kaolin, kieselguhr, etc.; (4) crystalline zeolitic aluminosilicates, such as X-zeolite, Y-zeolite, mordenite, or L-zeolite, either in the hydrogen form or in nonacidic form with one or more alkali metals occupying the cationic exchangeable sites; (5) non-zeolitic molecular sieves, such as aluminophosphates or silicoaluminophosphates; (6) spinels such as $MgAl_2O_4$, $FeAl_2O_4$, $ZnAl_2O_4$, $CaAl_2O_4$, and other like compounds having the formula $MO\text{-}Al_2O_3$ where M is a metal having a valence of 2; and (7) combinations of materials from one or more of these groups.

The preferred refractory inorganic oxide for use in the present invention is alumina. Suitable alumina materials are the crystalline aluminas known as the gamma-, eta-, and theta-alumina, with gamma- or eta-alumina giving best results. The preferred refractory inorganic oxide will have an apparent bulk density of about 0.3 to about 1.01 g/cc and surface area characteristics such that the average pore diameter is about 20 to 300 angstroms, the pore volume is about 0.05 to about 1 cc/g, and the surface area is about 50 to about 500 $m^2/g$.

A particularly preferred alumina is that which has been characterized in U.S. Pat. Nos. 3,852,190 and 4,012,313 as a byproduct from a Ziegler higher alcohol synthesis reaction as described in Ziegler's U.S. Pat. No. 2,892,858. For purposes of simplification, such an alumina will be hereinafter referred to as a "Ziegler alumina." Ziegler alumina is presently available from the Vista Chemical Company under the trademark "Catapal" or from Condea Chemie GMBH under the trademark "Pural." This material is an extremely high purity pseudo-boehmite powder which, after calcination at a high temperature, has been shown to yield a high-purity gamma-alumina.

The alumina powder may be formed into a suitable catalyst material according to any of the techniques known to those skilled in the catalyst-carrier-forming art. Spherical carrier particles may be formed, for example, from this Ziegler alumina by: (1) converting the alumina powder into an alumina sol by reaction with a suitable peptizing acid and water and thereafter dropping a mixture of the resulting sol and a gelling agent into an oil bath to form spherical particles of an alumina gel which are easily converted to a gamma-alumina carrier material by known methods; (2) forming an extrudate from the powder by established methods and thereafter rolling the extrudate particles on a spinning disk until spherical particles are formed which can then be dried and calcined to form the desired particles of spherical carrier material; and (3) wetting the powder with a suitable peptizing agent and thereafter rolling the particles of the powder into spherical masses of the desired size. This alumina powder can also be formed in any other desired shape or type of carrier material known to those skilled in the art such as rods, pills, pellets, tablets, granules, extrudates, and like forms by methods well known to the practitioners of the catalyst material forming art.

The preferred form of carrier material for the selective isoparaffin-synthesis catalyst is a cylindrical extrudate. The extrudate particle is optimally prepared by mixing the alumina powder with water and suitable peptizing agents such as nitric acid, acetic acid, aluminum nitrate, and the like material until an extrudable dough is formed. The amount of water added to form the dough is typically sufficient to give a Loss on Ignition (LOI) at 500° C. of about 45 to 65 mass %, with a value of 55 mass % being especially preferred. The resulting dough is then extruded through a suitably sized die to form extrudate particles.

The extrudate particles are dried at a temperature of about 150° to about 200° C., and then calcined at a temperature of about 450° to 800° C. for a period of 0.5 to 10 hours to effect the preferred form of the refractory inorganic oxide. It is preferred that the refractory inorganic oxide comprise substantially pure gamma alumina having an apparent bulk density of about 0.6 to about 1 g/cc and a surface area of about 150 to 280 $m^2/g$ (preferably 185 to 235 $m^2/g$, at a pore volume of 0.3 to 0.8 cc/g).

An essential component of the selective isoparaffin-synthesis catalyst is a platinum-group metal or nickel. Of the preferred platinum group, i.e., platinum, palladium, rhodium, ruthenium, osmium and iridium, palladium is a favored component and platinum is especially preferred. Mixtures of platinum-group metals also are within the scope of this invention. This component may exist within the final catalytic composite as a compound such as an oxide, sulfide, halide, or oxyhalide, in chemical combination with one or more of the other ingredients of the composite, or as an elemental metal. Best results are obtained when substantially all of this metal component is present in the elemental state. This component may be present in the final catalyst composite in any amount which is catalytically effective, and generally will comprise about 0.01 to 2 mass % of the final catalyst calculated on an elemental basis. Excellent results are obtained when the catalyst contains from about 0.05 to 1 mass % of platinum.

The platinum-group metal component may be incorporated into the selective isoparaffin-synthesis catalyst in any suitable manner such as coprecipitation or cogellation with the carrier material, ion exchange or impregnation. Impregnation using water-soluble compounds of the metal is preferred. Typical platinum-group compounds which may be employed are chloroplatinic acid, ammonium chloroplatinate, bromoplatinic acid, platinum dichloride, platinum tetrachloride hydrate, tetraamine platinum chloride, tetraamine platinum nitrate, platinum dichlorocarbonyl dichloride, dinitrodiaminoplatinum, palladium chloride, palladium chloride dihydrate, palladium nitrate, etc. Chloroplatinic acid is preferred as a source of the especially preferred platinum component.

It is within the scope of the present invention that the catalyst may contain other metal components known to modify the effect of the platinum-group metal component. Such metal modifiers may include rhenium, tin, germanium, lead, cobalt, nickel, indium, gallium, zinc, uranium, dysprosium, thallium, and mixtures thereof. Catalytically effective amounts of such metal modifiers may be incorporated into the catalyst by any means known in the art.

The composite, before addition of the Friedel-Crafts metal halide, is dried and calcined. The drying is carried out at a temperature of about 100° to 300°, followed by calcination or oxidation at a temperature of from about 375° to 600° C. in an air or oxygen atmosphere for a period of about 0.5 to 10 hours in order to convert the metallic components substantially to the oxide form.

The resultant oxidized catalytic composite is subjected to a substantially water-free and hydrocarbon-free reduction step. This step is designed to selectively reduce the platinum-group component to the corresponding metal and to insure a finely divided dispersion of the metal component throughout the carrier material. Substantially pure and dry hydrogen (i.e., less than 20 vol. ppm $H_2O$) preferably is used as the reducing agent in this step. The reducing agent is contacted with the oxidized composite at conditions including a temperature of about 425° C. to about 650° C. and a period of time of about 0.5 to 2 hours to reduce substantially all of the platinum-group metal component to its elemental metallic state.

Suitable metal halides comprising the Friedel-Crafts metal component of the selective isoparaffin-synthesis catalyst include aluminum chloride, aluminum bromide, ferric chloride, ferric bromide, zinc chloride and the like compounds, with the aluminum halides and particularly aluminum chloride ordinarily yielding best results. Generally, this component can be incorporated into the catalyst of the present invention by way of the conventional methods for adding metallic halides of this type; however, best results are ordinarily obtained when the metallic halide is sublimed onto the surface of the support according to the preferred method disclosed in U.S. Pat. No. 2,999,074, which is incorporated herein by reference.

As aluminum chloride sublimes at about 184° C., suitable impregnation temperatures range from about 190° C. to 750° C. with a preferable range being from about 500° C. to 650° C. The sublimation can be conducted at atmospheric pressure or under increased pressure and in the presence or absence of diluent gases such a hydrogen or light paraffinic hydrocarbons or both. The impregnation of the Friedel-Crafts metal halide may be conducted batch-wise, but a preferred method for impregnating the calcined support is to pass sublimed $AlCl_3$ vapors, in admixture with a carrier gas such as hydrogen, through a bed of reduced catalyst. This method both continuously deposits and reacts the aluminum chloride and also removes hydrogen chloride evolved during the reaction.

The amount of Friedel-Crafts metal halide combined with the calcined support may range from about 1 up to 15 mass % relative to the calcined composite prior to introduction of the metal-halide component. The composite containing the sublimed Friedel-Crafts metal halide is treated to remove the unreacted Friedel-Crafts metal halide by subjecting the composite to a temperature above the sublimation temperature of the Friedel-Crafts metal halide, preferably below about 750° C., for a time sufficient to remove any unreacted metal halide. In the case of $AlCl_3$, temperatures of about 500° C. to 650° C. and times of from about 1 to 48 hours are preferred.

An optional component of the present catalyst is an organic polyhalo component. In this embodiment, the composite is further treated preferably after introduction of the Friedel-Crafts metal halide in contact with a polyhalo compound containing at least 2 chlorine atoms and selected from the group consisting of methylene halide, haloform, methylhaloform, carbon tetrahalide, sulfur dihalide, sulfur halide, thionyl halide, and thiocarbonyl tetrahalide. Suitable polyhalo compounds thus include methylene chloride, chloroform, methylchloroform, carbon tetrachloride, and the like. In any case, the polyhalo compound must contain at least two chlorine atoms attached to the same carbon atom. Carbon tetrachloride is the preferred polyhalo compound. The composite contacts the polyhalo compound preferably diluted in a non-reducing gas such as nitrogen, air, oxygen and the like. The contacting suitably is effected at a temperature of from about 100° to 600° C. over a period of from about 0.2 to 5 hours to add at least 0.1 mass % combined halogen to the composite.

The catalyst of the present invention may contain an additional halogen component. The halogen component may be either fluorine, chlorine, bromine or iodine or mixtures thereof with chlorine being preferred. The halogen component is generally present in a combined state with the inorganic-oxide support. The halogen component may be incorporated in the catalyst in any suitable manner, either during the preparation of the inorganic-oxide support or before, while or after other catalytic components are incorporated. For example, chloroplatinic acid may be used in impregnating a platinum component. The halogen component is preferably well dispersed throughout the catalyst and may comprise from more than 0.2 to about 15 mass %, calculated on an elemental basis, of the final catalyst.

Water and sulfur are catalyst poisons especially for the chlorided platinum-alumina catalyst composition described hereinabove. Water can act to permanently deactivate the catalyst by removing high-activity chloride from the catalyst and replacing it with inactive aluminum hydroxide. Therefore, water and oxygenates that can decompose to form water can only be tolerated in very low concentrations. In general, this requires a limitation of oxygenates in the feed to about 0.1 ppm or less. Sulfur present in the feedstock serves to temporarily deactivate the catalyst by platinum poisoning. If sulfur is present in the feed, activity of the catalyst may be restored by hot hydrogen stripping of sulfur from the catalyst composition or by lowering the sulfur concentration in the incoming feed to below 0.5 ppm. The feed may be treated by any method that will remove water and sulfur compounds. Sulfur may be removed from the feed stream by hydrotreating. Adsorption systems for the removal of sulfur and water from hydrocarbon streams are well known to those skilled in the art.

The chlorided platinum-alumina catalyst described hereinabove also requires the presence of a small amount of an organic chloride promoter in the selective-isoparaffin-synthesis zone. The organic chloride promoter serves to maintain a high level of active chloride on the catalyst, as low levels are continuously stripped off the catalyst by the hydrocarbon feed. The concentration of promoter in the combined feed is maintained at from 30 to 300 mass ppm. The preferred promoter compound is carbon tetrachloride. Other suitable promoter compounds include oxygen-free decomposable organic chlorides such as propyldichloride, butylchloride, and chloroform, to name only a few of such compounds. The need to keep the reactants dry is reinforced by the presence of the organic chloride compound which may convert, in part, to hydrogen chloride. As long as the hydrocarbon feed and hydrogen are dried as described hereinabove, there will be no adverse effect from the presence of small amounts of hydrogen chloride.

Contacting within the selective-isoparaffin-synthesis zone may be effected using the catalyst in a fixed-bed system, a moving-bed system, a fluidized-bed system, or in a batch-type operation. In view of the danger of attrition loss of the valuable catalyst and of operational advantages, it is preferred to use a fixed-bed system. In this system, a hydrogen-rich gas and the charge stock are preheated by suitable heating means to the desired reaction temperature and then passed into a selective-isoparaffin-synthesis zone containing a fixed bed of the catalyst particles as previously characterized. The selective-isoparaffin-synthesis zone may be in a single reactor or in two or more separate reactors with suitable means therebetween to insure that the desired selective isoparaffin synthesis temperature is maintained at the entrance to each reactor. Two or more reactors in sequence are preferred to control individual reactor temperatures in light of the exothermic heat of reaction and for partial catalyst replacement without a process shutdown. The reactants may be contacted with the bed of catalyst particles in either upward, downward, or radial flow fashion. The reactants may be in the liquid phase, a mixed liquid-vapor phase, or a vapor phase when contacted with the catalyst particles.

Synthesis effluent from the selective-isoparaffin-synthesis zone 10 passes via line 13 to separation zone 20. The separation zone optimally comprises one or more fractional distillation columns having associated appurtenances and separating a light liquid product from light naphtha and from reforming feed at operating conditions known to those of ordinary skill in the art. The small amount of light gases produced in the selective isoparaffin synthesis unit generally are separated from the other products before distillation, but it is within the scope of the invention that the separation zone could also recover light gases and/or a propane product. The three major products, light liquid, light naphtha and reforming feed, optimally are separated in two successive distillation columns although a single column with a sidestream may be used in some cases. Light liquid may be recovered as an overhead stream from a first distillation column, with bottoms from the first column passing to a second column for separation of light naphtha from reforming feed. Usually, reforming feed is recovered as a bottoms stream from a first distillation column from which the overhead passes to a second column for separation of light liquid from light naphtha.

The light liquid optimally is an isobutane-rich stream, with a concentration of between about 70 and 95 mole % isobutane in total butanes, and is withdrawn from the separation zone through line 21. The light liquid optionally may comprise an isopentane-rich stream, more usually recovered in the light naphtha fraction as discussed hereinbelow, either in admixture with the isobutane or as a separate stream. A first portion of the light liquid passes via line 24 to dehydrogenation zone 40, and a second portion passes via line 25 to alkylation zone 60 as described hereinafter.

The light naphtha fraction normally comprises pentanes and hexanes in admixture, and also may contain smaller concentrations of naphthenes, benzene and $C_7$ hydrocarbons. Usually over 80 mole %, and preferably over 90 mole %, of the $C_6$ hydrocarbons recovered from the selective-isoparaffin-synthesis zone are contained in the light naphtha; $C_6$ hydrocarbons in the reforming feed would be partially converted to benzene, which is undesirable in gasoline for environmental reasons. The light naphtha is withdrawn from the separation zone via line 22, and may pass to gasoline blending via line 26 or optionally to isomerization via line 27. Since the synthesis pentanes already contain a higher proportion of isopentane than generally would be obtained by isomerization, only the $C_6$ portion of the light naphtha usually would benefit from isomerization. An attractive alternative therefore is to separate an isopentane-rich stream either to gasoline blending or as part of the light liquid to dehydrogenation as discussed in more detail elsewhere in this specification.

Reforming feed is withdrawn from the separation zone via line 23 and introduced into reforming zone 30. The reforming zone upgrades the octane number of the reforming feed through a variety of reactions including naphthene dehydrogenation and paraffin dehydrocyclization and isomerization. Product reformate passes through line 31 to gasoline blending.

Reforming operating conditions used in the reforming zone of the present invention include a pressure of from about atmospheric to 60 atmospheres (absolute), with the preferred range being from atmospheric to 20 atmospheres and a pressure of below 10 atmospheres being especially preferred. Hydrogen is supplied to the reforming zone in an amount sufficient to correspond to a ratio of from about 0.1 to 10 moles of hydrogen per mole of hydrocarbon feedstock. The volume of the contained reforming catalyst corresponds to a liquid hourly space velocity of from about 1 to 40 $hr^{-1}$. The operating temperature generally is in the range of 260° to 560° C.

The reforming catalyst is a dual-function composite containing a metallic hydrogenation-dehydrogenation component on a refractory support which provides acid sites for cracking, isomerization, and cyclization. The refractory support of the reforming catalyst should be a porous, adsorptive, high-surface-area material which is uniform in composition without composition gradients of the species inherent to its composition. Within the scope of the present invention are refractory supports containing one or more of: (1) refractory inorganic oxides such as alumina, silica, titania, magnesia, zirconia, chromia, thoria, boria or mixtures thereof; (2) synthetically prepared or naturally occurring clays and silicates, which may be acid-treated; (3) crystalline zeolitic aluminosilicates, either naturally occurring or synthetically prepared such as FAU, MEL, MFI, MOR, MTW (IUPAC Commission on Zeolite Nomenclature), in hydrogen form or in a form which has been exchanged with metal cations; (4) spinels such as $MgAl_2O_4$, $FeAl_2O_4$, $ZnAl_2O_4$, $CaAl_2O_4$; and (5) combinations of materials from one or more of these groups. The preferred refractory support for the reforming catalyst is alumina, with gamma- or eta-alumina being particularly preferred. Best results are obtained with "Ziegler alumina" as described above in connection with the selective isoparaffin-synthesis catalyst.

The alumina powder may be formed into any shape or form of carrier material known to those skilled in the art such as spheres, extrudates, rods, pills, pellets, tablets or granules. Preferred spherical particles may be formed by converting the alumina powder into alumina sol by reaction with suitable peptizing acid and water and dropping a mixture of the resulting sol and gelling agent into an oil bath to form spherical particles of an alumina gel, followed by known aging, drying and calcination steps. The alternative extrudate form is preferably prepared by mixing the alumina powder with water and suitable peptizing agents, such as nitric acid, acetic acid, aluminum nitrate and like materials, to form an extrudable dough having a loss on ignition (LOI) at 500° C. of about 45 to 65 mass %. The resulting dough is extruded through a suitably shaped and sized die to form extrudate particles, which are dried and calcined by known methods. Alternatively, spherical particles can be formed from the extrudates by rolling the extrudate particles on a spinning disk.

An essential component of the reforming catalyst is one or more platinum-group metals, with a platinum component being preferred. The platinum may exist within the catalyst as a compound such as the oxide, sulfide, halide, or oxyhalide, in chemical combination with one or more other ingredients of the catalytic composite, or as an elemental metal. Best results are obtained when substantially all of the platinum exists in the catalytic composite in a reduced state. The platinum component generally comprises from about 0.01 to 2 mass % of the catalytic composite, preferably 0.05 to 1 mass %, calculated on an elemental basis. It is within the scope of the present invention that the catalyst may contain other metal components known to modify the effect of the preferred platinum component. Such metal modifiers may include Group IVA (14) metals, other Group VIII (8-10) metals, rhenium, indium, gallium, zinc, uranium, dysprosium, thallium and mixtures thereof, with a tin component being especially preferred. Catalytically effective amounts of such metal modifiers may be incorporated into the catalyst by any means known in the art.

The reforming catalyst optimally contains a halogen component. The halogen component may be either fluorine, chlorine, bromine or iodine or mixtures thereof. Chlorine is the preferred halogen component. The halogen component is generally present in a combined state with the organic-oxide support. The halogen component is preferably well dispersed throughout the catalyst and may comprise from more than 0.2 to about 15 mass %, calculated on an elemental basis, of the final catalyst.

The reforming catalyst is dried at a temperature of from about 100° to 320° C. for about 0.5 to 24 hours, followed by oxidation at a temperature of about 300° to 550° C. in an air atmosphere for 0.5 to 10 hours. Preferably the oxidized catalyst is subjected to a substantially water-free reduction step at a temperature of about 300° to 550° C. for 0.5 to 10 hours or more. Further details of the preparation and activation of embodiments of the reforming catalyst are disclosed in U.S. Pat. No. 4,677,094 (Moser et al.), which is incorporated into this specification by reference thereto.

The naphtha feedstock may contact the reforming catalyst in either upflow, downflow, or radial-flow mode. Since the present reforming process operates at relatively low pressure, the low pressure drop in a radial-flow reactor favors the radial-flow mode.

The catalyst is contained in a fixed-bed reactor or in a moving-bed reactor whereby catalyst may be continuously withdrawn and added. These alternatives are associated with catalyst-regeneration options known to those of ordinary skill in the art, such as: (1) a semiregenerative unit containing fixed-bed reactors maintains operating severity by increasing temperature, eventually shutting the unit down for catalyst regeneration and reactivation; (2) a swing-reactor unit, in which individual fixed-bed reactors are serially isolated by manifolding arrangements as the catalyst become deactivated and the catalyst in the isolated reactor is regenerated and reactivated while the other reactors remain on-stream; (3) continuous regeneration of catalyst withdrawn from a moving-bed reactor, with reactivation and substitution of the reactivated catalyst, permitting higher operating severity by maintaining high catalyst activity through regeneration cycles of a few days; or: (4) a hybrid system with semiregenerative and continuous-regeneration provisions in the same unit. The preferred embodiment of the present invention is a moving-bed reactor with continuous catalyst regeneration, in order to realize high yields of desired $C_5+$ product at relatively low operating pressures associated with more rapid catalyst deactivation.

Total product from the reforming zone generally is processed in a fractional distillation column to separate normally gaseous components from reformate. It is within the scope of the invention also to separate a light reformate from a heavy reformate by fractional distillation. Preferably, the light reformate will comprise pentanes either with or without a substantial concentration of $C_6$ hydrocarbons, and may be sent to an isomerization zone along with light naphtha. Heavy reformate generally is blended directly into gasoline. In any case, reformate from the reforming zone 30 is sent to gasoline blending via line 31.

A portion of the light liquid, comprising an isobutane-rich stream, recovered from the separation zone 20 as described hereinabove passes via line 24 to dehydrogenation zone 40. The proportion of light liquid sent to the dehydrogenation unit depends on other uses of light liquid in a petroleum refinery, especially the need for isobutane in alkylation of olefins. In the dehydrogenation zone, isobutane is converted selectively to isobutene. Optionally, part or all of the isopentane also is dehydrogenated to yield isopentene as additional etherification feed. The isoolefin-containing stream leaving the dehydrogenation zone via line 41 thus contains isobutene and may contain isopentene.

Dehydrogenation conditions generally include a pressure of from about 0 to 35 atmospheres, more usually no more than about 5 atmospheres. Suitable temperatures range from about 480° C. to 760° C., optimally from about 540° C. to 705° C. when processing a light liquid comprising isobutane and/or isopentane. Catalyst is available in dehydrogenation reactors to provide a liquid hourly space velocity of from about 1 to 10, and preferably no more than about 5. Hydrogen is admixed with the hydrocarbon feedstock in a mole ratio of from about 0.1 to 10, and more usually from about 0.5 to 2.

The dehydrogenation catalyst comprises a platinum-group metal component and an alkali-metal component on a refractory support. The catalyst also may contain promoter metals which improve its performance. The refractory support of the dehydrogenation catalyst should be a porous, absorptive high-surface-area material as delimited hereinabove for the reforming catalyst. A refractory inorganic oxide is the preferred support, with alumina being particularly preferred.

The platinum-group metal component generally comprises from about 0.01 to about 2 mass % of the final catalytic composite, calculated on an elemental basis. Preferably the platinum component comprises platinum in an amount equal to between about 0.1 and 1 mass %.

The preferred catalyst also contains an alkali metal component chosen from cesium, rubidium, potassium, sodium, and lithium in a concentration of from about 0.1 to 5 mass %. Preferably, the catalyst contains between 1 and about 4 mass % of potassium or lithium calculated on an elemental basis.

The dehydrogenation catalyst may also contain a promoter metal such as tin in an amount of from about 0.01 to about 1 mass %, on an elemental basis, and preferably in an atomic ratio of tin to platinum be between 1:1 and about 6:1.

A suitable dehydrogenation reaction zone for this invention preferably comprises one or more radial-flow reactors through which the catalyst gravitates downward with continuous removal of spent catalyst. A detailed description of the moving-bed reactors herein contemplated may be obtained by reference to U.S. Pat. No. 3,978,150. Preferably, the dehydrogenation reactor section comprises multiple stacked or side-by-side reactors, and a combined stream of hydrogen and hydrocarbons is processed serially through the multiple reactors each of which contains a particulate catalyst disposed as an annular-form downwardly moving bed. The moving catalyst bed permits a continuous addition of fresh and/or regenerated catalyst and the withdrawal of spent catalyst, and is illustrated in U.S. Pat. No. 3,647,680. Since the dehydrogenation reaction is endothermic in nature, intermediate heating of the reactant stream between zones is the optimal practice.

The dehydrogenation zone will produce an isoolefin-containing stream containing a near-equilibrium mixture of the desired isoolefin and its isoalkane precursor. Preferably an isobutane-rich stream is processed to yield an isobutene-containing stream. Optionally, the dehydrogenation zone also processes an isopentane-rich stream to obtain an isopentene-containing stream. Hydrogen is produced and appears in the product from the reactors along with light hydrocarbons originating as impurities in the feed or produced by side reactions. A separation section recovers hydrogen from the product in high purity by known means for recycle to the reaction section and recovery of a net hydrogen stream for use elsewhere. The separation section can be designed to remove a major portion of $CH_4$, $C_2$ and $C_3$ hydrocarbons in addition to hydrogen. To the extent that liquid phase conditions are desired in the etherification zone, removal of these light gases will permit reduction of the etherification-zone operating pressure.

A first portion of the isoolefin-containing stream passes from the dehydrogenation zone to the etherification zone 50 via line 42. The proportion of this stream which is etherified depends on overall gasoline needs and specifications, and particularly on the oxygen content of the gasoline and the need for alkylate as a blending component; sending a higher proportion to etherification would result in a higher gasoline oxygen content.

The olefin-containing stream preferably contains isobutene, and optionally comprises isopentene. In addition, one or more monohydroxy alcohols are fed to the etherification zone via line 51. Ethanol is a preferred monohydroxy-alcohol feed, and methanol is especially preferred. This variety of possible feed materials allows the production of a variety of ethers in addition to or instead of the preferred methyl tertiary-butyl ether (MTBE). These useful ethers include ethyl tertiary butyl ether (ETBE), methyl tertiary amyl ether (MTAE) and ethyl tertiary amyl ether (ETAE).

In the etherification zone, olefins are combined with one or more monohydroxy alcohols to obtain an ether compound having a higher boiling point than the olefin precursor. In order to obtain complete conversion, an excess of the alcohol is usually present in the etherification zone. It has been found that the presence of hydrocarbons having fewer carbon atoms than the olefin reactants will not unduly interfere with the operation of the etherification zone if the proportion is not so high as to affect throughput significantly. The major effect on the etherification zone resulting from the presence of relatively small amounts of additional light materials such as methane, $C_2$ and $C_3$ hydrocarbons is increased pressure. These changes will not interfere with the olefin reactions or increase the operational utilities as long as the methane content is low.

Processes operating with vapor, liquid or mixed-phase conditions may be suitably employed in this invention. The preferred etherification process uses liquid-phase etherification conditions, including a superatmospheric pressure sufficient to maintain the reactants in liquid phase but no more than about 50 atmospheres; even in the presence of additional light materials, pressures in the range of 10 to 40 atmospheres generally are sufficient to maintain liquid-phase conditions. Operating temperature is between about 30° C. and 100° C.; the reaction rate is normally faster at higher temperatures, but conversion is more complete at lower temperatures. High conversion in a moderate volume reaction zone can, therefore, be obtained if the initial section of the reaction zone, e.g., the first two-thirds, is maintained above 70° C. and the remainder of the reaction zone is maintained below 50° C. This may be accomplished most easily with two reactors.

The ratio of feed alcohol to isoolefin should normally be maintained in the broad range of 1:1 to 2:1. With the preferred reactants, good results are achieved if the ratio of methanol to isobutene is between 1.05:1 and 1.5:1. An excess of methanol, above that required to achieve satisfactory conversion at good selectivity, should be avoided as some decomposition of methanol to dimethylether may occur with a concomitant increase in the load on separation facilities.

A wide range of materials are known to be effective as etherification catalysts including mineral acids such as sulfuric acid, boron trifluoride, phosphoric acid on kieselguhr, phosphorus-modified zeolites, heteropoly acids, and various sulfonated resins. The use of a sulfonated solid resin catalyst is preferred. These resin type catalysts include the reaction products of phenolformaldehyde resins and sulfuric acid and sulfonated polystyrene resins including those cross-linked with divinylbenzene. Further information on suitable etherification catalysts may be obtained by reference to U.S. Pat. Nos. 2,480,940, 2,922,822, and 4,270,929 and the previously cited etherification references.

In the preferred etherification process for the production of MTBE, essentially all of the isobutene is converted to MTBE thereby eliminating the need for subsequently separating that olefin from isobutane. As a result, downstream separation facilities are simplified. Several suitable etherification processes have been described in the literature which presently are being used to produce MTBE. The preferred form of the etherification zone is similar to that described in U.S. Pat. No. 4,219,678. In this instance, the isobutene, methanol and a recycle stream containing recovered excess alcohol are passed into the etherification zone and contacted at etherification conditions with an acidic etherification catalyst to produce an effluent containing MTBE.

The effluent from the etherification-zone reactor section includes at least product ethers, light hydrocarbons, dehydrogenatable hydrocarbons, and any excess alcohol. The effluent may also include small amounts of hydrogen and of other oxygen-containing compounds such as dimethyl ether and TBA. The effluent passes from the etherification reactor section to a separation section for the recovery of product. The etherification effluent is separated to recover the ether product to blending, preferably by fractional distillation with ether being taken as bottoms product; this product generally is suitable for gasoline blending via line 52 but may be purified further, e.g., by azeotropic distillation.

The overhead from ether separation containing unreacted hydrocarbons is passed through a methanol recovery zone for the recovery of methanol, preferably by adsorption, with return of the methanol to the etherification reactor section. The hydrocarbon-rich stream is fractionated to remove $C_3$ and lighter hydrocarbons and oxygenates from the stream of unreacted $C_4$–$C_5$ hydrocarbons. Heavier oxygenate compounds are removed by passing the stream of unreacted hydrocarbons through a separate oxygenate recovery unit. This hydrocarbon raffinate, after oxygenate removal, may be dehydrogenated to provide additional feedstock for the etherification zone or used as part of the feed to an alkylation reaction zone to produce high octane alkylate.

A second portion of the isobutane-rich light liquid stream from the separation zone and a second portion of the isoolefin-containing stream from the dehydrogenation zone pass to the alkylation zone via lines 25 and 43, respectively. The isoolefin-containing stream comprises isobutene and, preferably, isopentene. The first portion of the isobutane-rich light liquid to dehydrogenation and the second portion to alkylation preferably represent the total light liquid recovered in the separation zone, but some isobutane-rich liquid may be sent to other petroleum-refinery uses outside the present process combination. Similarly, the first portion of the isoolefin-containing stream to etherification and the second portion to alkylation preferably comprise the total isoolefin from dehydrogenation. The alkylation zone optionally may process other isobutane- or olefin-containing streams from an associated petroleum refinery.

The alkylation zone of this invention may be any acidic catalyst reaction system such as a hydrogen fluoride-catalyzed system, sulfuric-acid system or one which utilizes an acidic catalyst in a fixed-bed reaction system. Hydrogen fluoride alkylation is particularly preferred, and may be conducted substantially as set forth in U.S. Pat. No. 3,249,650. The alkylation reaction in the presence of hydrogen fluoride catalyst is conducted at a catalyst to hydrocarbon volume ration within the alkylation reaction zone of from about 0.2 to 2.5 and preferably about 0.5 to 1.5. Ordinarily, anhydrous hydrogen fluoride will be charged to the alkylation system as fresh catalyst; however, it is possible to utilize hydrogen fluoride containing as much as 10.0% water or more. Excessive dilution with water is generally to be avoided since it tends to reduce the alkylating activity of the catalyst and further introduces corrosion problems. In order to reduce the tendency of the olefinic portion of the charge stock to undergo polymerization prior to alkylation, the molar proportion of isoparaffins to olefinic hydrocarbons in an alkylation reactor is desirably maintained at a value greater than 1.0, and preferably from about 3.0 to 15.0. Alkylation reaction conditions, as catalyzed by hydrogen fluoride, include a temperature of from −20° to about 100° C., and preferably from about 0° to 50° C. The pressure maintained within the alkylation system is ordinarily at a level sufficient to maintain the hydrocarbons and catalyst in a substantially liquid phase; that is, from about atmospheric to 40 atmospheres. The contact time within the alkylation reaction zone is conveniently expressed in terms of space-time, being defined as the volume of catalyst within the reactor contact zone divided by the volume rate per minute of hydrocarbon reactants charged to the zone. Usually the space-time will be less than 30 minutes and preferably less than about 15 minutes.

Alkylate recovered from the alkylation zone via line 61 generally comprises n-butane and heavier components, isobutane and lighter materials having been removed by fractionation and returned to the reactor. At least a portion, and preferably all, of the alkylate is blended into the present gasoline component.

The light naphtha fraction recovered from the separation zone 20 via line 22 may pass directly to gasoline blending via line 26, since the pentanes are particularly rich in isopentane and the hexanes generally have a higher proportion of branched isomers than the hexanes fraction distilled from crude oil. Optionally, although the light naphtha has an antiknock quality useful for gasoline blending, this fraction may be conducted to an isomerization zone 70 for further upgrading of its octane number via line 27. As mentioned hereinabove, light reformate also may be separated and sent to the isomerization zone. It also is within the scope of the invention that an optional naphtha feedstock, for example a $C_5/C_6$ fraction derived from crude oil, is isomerized in the isomerization zone in admixture with the light naphtha fraction.

Isomerization conditions in the isomerization zone include reactor temperatures usually ranging from about 40° to 250° C. Lower reaction temperatures are generally preferred wherein the equilibrium favors higher concentrations of isoalkanes relative to normal alkanes. Lower temperatures are particularly desirable in order to favor equilibrium mixtures having the highest concentration of high-octane highly branched isoalkanes and to minimize cracking of the feed to lighter hydrocarbons. Temperatures in the range of from about 40° to about 150° C. are preferred in the present invention.

Reactor operating pressures generally range from about atmospheric to 100 atmospheres, with preferred pressures in the range of from 20 to 35 atmospheres. Liquid hourly space velocities range from about 0.25 to about 12 volumes of isomerizable hydrocarbon feed per hour per volume of catalyst, with a range of about 0.5 to 5 $hr^{-1}$ being preferred.

Hydrogen is admixed with the feed to the isomerization zone to provide a mole ratio of hydrogen to hydrocarbon feed of about 0.01 to 5. The hydrogen may be supplied totally from outside the process or supplemented by hydrogen recycled to the feed after separation from reactor effluent. Light hydrocarbons and small amounts of inerts such as nitrogen and argon may be present in the hydrogen. Water should be removed from hydrogen supplied from outside the process, preferably by an adsorption system as is known in the art.

Although there is no net consumption of hydrogen in the isomerization reaction, hydrogen generally will be consumed in a number of side reactions such as cracking, disproportionation, and aromatics and olefin saturation. Such hydrogen consumption typically will be in a mole ratio to the hydrocarbon feed of about 0.03 to 0.1. Hydrogen in excess of consumption requirements is maintained in the reaction zone to enhance catalyst stability and maintain conversion by compensation for variations in feed composition, as well as to suppress the formation of carbonaceous compounds, usually referred to as coke, which foul the catalyst particles.

In a preferred embodiment, the hydrogen to hydrocarbon mole ratio in the reactor effluent is equal to or less than 0.05. Generally, a mole ratio of 0.05 or less obviates the need to recycle hydrogen from the reactor effluent to the feed. It has been found that the amount of hydrogen needed for suppressing coke formation need not exceed dissolved hydrogen levels. The amount of hydrogen in solution at the normal conditions of the reactor effluent will usually be in a molar ratio to hydrocarbons of from about 0.02 to less than 0.01. The amount of excess hydrogen over consumption requirements that is required for good stability and conversion is in a molar ratio of hydrogen to hydrocarbons of from 0.01 to less than 0.05 as measured at the effluent of the isomerization zone. Adding the dissolved and excess hydrogen proportions show that the 0.05 hydrogen to hydrocarbon ratio at the effluent will satisfy these requirements for most feeds.

Any catalyst known in the art to be suitable for the isomerization of paraffin-rich hydrocarbon streams may be used as an isomerization catalyst in the isomerization zone. One suitable isomerization catalyst comprises a platinum-group metal, hydrogen-form crystalline aluminosilicate and a refractory inorganic oxide. Best isomerization results are obtained when the composition has a surface area of at least 580 $m^2/g$. The preferred noble metal is platinum which is present in an amount of from about 0.01 to 5 mass % of the composition, and optimally from about 0.15 to 0.5 mass %. Catalytically effective amounts of one or more promoter metals preferably selected from Groups VIB(6), VIII(8-10), IB(11), IIB(12), IVA(14), rhenium, iron, cobalt, nickel, gallium and indium also may be present. The crystalline aluminosilicate may be synthetic or naturally occurring, and preferably is selected from the group consisting of FAU, LTL, MAZ and MOR with mordenite having a silica-to-alumina ratio of from 16:1 to 60:1 being especially preferred. The crystalline aluminosilicate generally comprises from about 50 to 99.5 mass % of the composition, with the balance being the refractory inorganic oxide. Alumina, and preferably one or more of gamma-alumina and eta-alumina, is the preferred inorganic oxide. Further details of the composition are disclosed in U.S. Pat. No. 4,735,929, incorporated herein by reference thereto.

A preferred isomerization catalyst composition comprises one or more platinum-group metals, a halogen, and an inorganic-oxide binder. Preferably the catalyst contains a Friedel-Crafts metal halide, with aluminum chloride being especially preferred. The optimal platinum-group metal is platinum which is present in an amount of from about 0.1 to 0.5 mass %. The composition may also contain an organic polyhalo component, with carbon tetrachloride being preferred, and the total chloride content is from about 2 to 10 mass %. The inorganic oxide preferably comprises alumina, with one or more of gamma-alumina and eta-alumina providing best results. Optimally, the carrier material is in the form of a calcined cylindrical extrudate. Other details, alternatives and preparation steps of the preferred isomerization catalyst are as presented hereinabove for the selective isoparaffin-synthesis catalyst. Optionally, the same catalyst may be used in the selective isoparaffin synthesis and isomerization zones. U.S. Pat. Nos. 2,999,074 and 3,031,419 teach additional aspects of this composition and are incorporated herein by reference.

Water and sulfur are catalyst poisons especially for the chlorided platinum-alumina catalyst composition described hereinabove. Water can act to permanently deactivate the catalyst by removing high-activity chloride from the catalyst and replacing it with inactive aluminum hydroxide. Therefore, water and oxygenates that can decompose to form water can only be tolerated in very low concentrations. In general, this requires a limitation of oxygenates in the feed to about 0.1 ppm or less. Sulfur present in the feedstock serves to temporarily deactivate the catalyst by platinum poisoning. The present isomerization feed is not expected to contain a significant amount of sulfur, since it has been derived from the selective-isoparaffin-synthesis zone. Adsorption systems for the removal of sulfur and water from hydrocarbon streams may be used to ensure low levels of these contaminants in the isomerization feed.

An organic chloride promoter is required to maintain a high level of active chloride on the preferred catalyst, as discussed hereinabove in relation to the preferred selective isoparaffin-synthesis catalyst. The concentration of promoter in the combined feed is maintained at from 30 to 300 mass ppm.

Contacting within the isomerization zone may be effected using the catalyst in a fixed-bed system, a moving-bed system, a fluidized-bed system, or in a batch-type operation. A fixed-bed system is preferred. The isomerization zone may be in a single reactor or in two or more separate reactors with suitable means therebetween to ensure that the desired isomerization temperature is maintained at the entrance to each zone. Two or more reactors in sequence are preferred to enable improved isomerization through control of individual reactor temperatures and for partial catalyst replacement without a process shutdown. The reactants may be contacted with the bed of catalyst particles in either upward, downward, or radial-flow fashion. The reactants may be in the liquid phase, a mixed liquid-vapor phase, or a vapor phase when contacted with the catalyst particles, with excellent results being obtained by application of the present invention to a primarily liquid-phase operation.

Isomerate will be taken as a product of the process combination via line 71, and usually sent to gasoline blending. Isomerate recovered from once-through processing of light naphtha does contain some low-octane normal paraffins and intermediate-octane methylhexanes as well as the desired highest-octane isopentane and dimethylbutane. It is within the scope of the present invention that the product from the reactors of the isomerization process is subjected to separation and recycle of the lower-octane portion to the isomerization reaction. Generally, low-octane normal paraffins may be separated and recycled to upgrade the octane number of the upgraded isomerate. Less-branched hexanes also may be separated and recycled, along with smaller concentrations of hydrocarbons which are difficult to separate from the recycle. Techniques to achieve this separation are well known in the art, and include fractionation and molecular-sieve adsorption.

At least a portion each of reformate, ether product, and light naphtha and/or isomerate are blended to produce a gasoline component. The component preferably comprises all of the hydrocarbon products and a substantial portion of the ether produced by the present process combination, and may comprise all of the ether product. Optional constituents of the gasoline component are heavy and light reformate from fractionation of the reformate and upgraded isomerate produced by subjecting the isomerate to fractionation and/or molecular sieve adsorption as discussed hereinabove. The ether content of the gasoline will be determined by the desired or allowable oxygen content of the gasoline, inter alia. Oxygen contents of 1.5, 2.0 and 2.7 mass % have been mentioned in connection with reformulated gasoline. The oxygen content of the present gasoline component may be substantially higher than the aforementioned values prior to inclusion of other constituents in the final gasoline blend.

Finished gasoline may be produced by blending the gasoline component with other constituents including but not limited to one or more of butanes, butenes, pentanes, naphtha, catalytic reformate, isomerate, alkylate, polymer, aromatic extract, heavy aromatics; gasoline from catalytic cracking, hydrocracking, thermal cracking, thermal reforming, steam pyrolysis and coking; oxygenates from sources outside the combination such as methanol, ethanol, propanol, isopropanol, TBA, SBA, MTBE, ETBE, MTAE and higher alcohols and ethers; and small amounts of additives to promote gasoline stability and uniformity, avoid corrosion and weather problems, maintain a clean engine and improve driveability. The order of blending is not critical to the invention, e.g., one or more of the aforementioned constituents may be blended with the reformate, light naphtha and/or isomerate before these are combined into the present gasoline component, with the ether added as the final major component; the order of blending is not a feature of the invention.

If the total reformate and light naphtha and a substantial portion of the ether, along with any isomerized light product produced by the optional isomerization step, are blended into the gasoline component, the aromatics content of the component will be substantially lower than the aromatics content of a catalytic reformate produced from the naphtha feedstock at the same octane number. The reduction in aromatic content may amount to from 10 to 60 volume % of the gasoline component, or more usually 20 to 45%. Stated in another way, if the total $C_5+$ product and MTBE from the present combination is blended up to 2.7 mass % oxygen in the component and the octane number is measured, and if the naphtha feedstock is catalytically reformed at the same operating pressure as the reforming pressure of the present process combination to yield product having the same octane number as the present blended $C_5+$ product, the present invention will yield a reduced product-aromatics content. This reduction in aromatics content is desirable, since future "reformulated" gasolines are likely to require reductions in aromatics content as well as vapor pressure, olefins and heavy components (*Chemical Engineering*, January, 1990, pp. 30–35). An increased oxygen content also will be required to meet more stringent emission requirements. Since catalytic reformate comprises generally over 30% of the U.S. gasoline pool, and since aromatics have been a major contributor to maintaining U.S. gasoline octane as lead additives have been removed, a process combination converting reforming feed to reduce the aromatics content and increase the oxygen content of gasoline while maintaining octane number should find utility in the industry.

EXAMPLES

The following examples serve to illustrate certain specific embodiments of the present invention. These examples should not, however, be construed as limiting the scope of the invention as set forth in the claims. There are many possible other variations, as those of ordinary skill in the art will recognize, which are within the spirit of the invention.

EXAMPLE 1

The benefits of producing a gasoline component using the process combination of the invention are illustrated by contrasting results with those from the process of the prior art. Example 1 presents results from the prior-art process.

The feedstock used in all examples is a full-range naphtha derived from a paraffinic mid-continent crude oil and having the following characteristics:

| | |
|---|---|
| Specific gravity | 0.746 |
| Distillation, ASTM D-86, °C. | |
| IBP | 86 |
| 50% | 134 |
| EP | 194 |
| Mass % paraffins | 63.7 |
| naphthenes | 24.0 |
| aromatics | 12.3 |

The prior-art process is a reforming operation using a chlorided platinum-tin-alumina catalyst. Operating pressure was established as 8.5 atmosphere gauge, consistent with numerous commercial operations employing catalyst regeneration. Temperature and space velocity were adjusted to achieve the product octane numbers described hereinafter. Product octane number was characterized as RON ( Research Octane Number, ASTM D-2699).

Pertinent reforming for comparison with the process of the invention are as follows:

| | |
|---|---|
| Product RON clear | 94.0 |
| $C_5$+ product yield, vol. % | 84.8 |
| Aromatics in $C_5$+ product, vol. % | 60 |

EXAMPLE 2

The naphtha feedstock of Example 1 was processed to effect selective isoparaffin synthesis, yielding light isoparaffins and an enriched, lower-boiling reforming feed, using a platinum-$AlCl_3$-on-alumina catalyst as described hereinabove. The extruded catalyst contained about 0.247 mass % platinum and 5.5 mass % chloride.

In five separate tests, selective-isoparaffin-synthesis conversion was varied in order to demonstrate the flexibility of the invention. Temperature was varied as indicated to obtain a range of conversion:

| | Case A | Case B | Case C | Case D | Case E |
|---|---|---|---|---|---|
| Temperature, °C. | 96 | 116 | 136 | 160 | 180 |
| Yield, Mass % | | | | | |
| $C_3$ and lighter | 0.24 | 0.86 | 2.14 | 3.80 | 6.23 |
| Butanes | 6.45 | 15.33 | 25.16 | 30.78 | 33.92 |
| $C_5/C_6$ | 18.66 | 27.63 | 33.31 | 34.79 | 37.44 |
| $C_7$+ naphtha | 74.65 | 56.18 | 39.39 | 30.63 | 22.41 |

Conversion according to the invention is not limited to the range of these examples, but may also be higher or lower as determined by the needs of the user.

The isoparaffin content of the product was high, ranging from 95% at low conversion to 85% at high conversion of the butanes and from 93 to 74 mass % of the pentanes.

EXAMPLE 3

The process combination of the invention is exemplified applying the yields of Example 2. Overall yields and product properties are determined based on a naphtha feedstock quality to selective isoparaffin synthesis of 10,000 B/SD (barrels per steam day). The isobutane-rich product stream is divided between dehydrogenation zone and an alkylation zone. The product isobutene-containing stream is divided between an etherification zone, to yield MTBE, and the alkylation zone along with the isobutane to obtain alkylate. The light $C_5/C_6$ naphtha is sent directly to gasoline blending. $C_7$+ reforming feed naphtha is processed in the reforming zone at a severity required for a Research octane number of 94.0 in the blended gasoline component, corresponding to that of a typical mid-grade unleaded gasoline (this could not be attained in Case E). Reforming conditions otherwise are as described in Example 1, in order to be consistent with the reference comparative case employing reforming only. Yields and product properties are derived from pilot-plant and commercial operations and correlations on similar stocks.

The light naphtha, reformate, unconverted $C_4$ and MTBE are blended to yield a gasoline component of the invention having an oxygen content of 1.5 mass %. The aromatics content of this component may be compared with that of reformate produced at the same octane number from naphtha feedstock according to Example 1. Results are as follows, referring to the case designations of Example 2:

| | Case A | Case B | Case C | Case D | Case E |
|---|---|---|---|---|---|
| B/SD: | | | | | |
| MTBE | 750 | 770 | 770 | 755 | 730 |
| Alkylate | 85 | 930 | 1,840 | 2,320 | 2,465 |
| $C_5/C_6$ | 2,065 | 3,120 | 3,770 | 3,950 | 4,270 |
| Reformate | 5,980 | 4,550 | 3,190 | 2,445 | 1,830 |
| Gasoline Component | 8,880 | 9,370 | 9,570 | 9,470 | 9,295 |
| RON Clear | 94.0 | 94.0 | 94.0 | 94.0 | 92.5* |
| Aromatics, Vol. % | 42 | 32 | 24 | 20 | 16 |
| Oxygen, Mass % | 1.5 | 1.5 | 1.5 | 1.5 | 1.5 |

*Unable practically to produce 94 RON component

The aromatics content of the gasoline component is lower than that of the reference of Example 1 by 18 to 44% in these examples. The quantity of gasoline component from the same quality of feedstock is increased by between 5 and 13% over the reference.

EXAMPLE 4

The oxygen content of reformulated gasoline in non-compliance urban areas is due to be required to be above 2.7 mass %. To illustrate the impact of the invention, gasoline components with a maximum of 2.7 mass % oxygen are blended in the same format as Example 3:

| | Case A | Case B | Case C | Case D | Case E |
|---|---|---|---|---|---|
| B/SD: | | | | | |
| MTBE | 865 | 1,425 | 1,435 | 1,405 | 1,345 |
| Alkylate | 0 | 445 | 1,350 | 1,840 | 2,010 |
| $C_5/C_6$ | 2,065 | 3,120 | 3,770 | 3,950 | 4,270 |
| Reformate | 6,000 | 4,700 | 3,400 | 2,630 | 1,835 |
| Gasoline Component | 8,930 | 9,690 | 9,955 | 9,825 | 9,460 |
| RON Clear | 94.0 | 94.0 | 94.0 | 94.0 | 94.0 |

-continued

| | Case A | Case B | Case C | Case D | Case E |
|---|---|---|---|---|---|
| Aromatics, Vol. % | 41 | 29 | 21 | 18 | 15 |
| Oxygen, Mass % | 1.7* | 2.7 | 2.7 | 2.7 | 2.7 |

*Maximum attainable

The gasoline component of the invention shows a substantial reduction in aromatics content and increase in volume in comparison to the Example 1 reference.

EXAMPLE 5

An optional process combination of the invention is exemplified by isomerization of the $C_5/C_6$ paraffins from selective isoparaffin synthesis in a once-through operation employing a chlorided platinum-on-alumina catalyst in accordance with the teachings of U.S. Pat. No. 2,900,425.

In another embodiment the $C_5/C_6$ isomerization is a recycle operation, with the separation and recycle of low-octane paraffins from the isomerization product. The recycle comprises primary singly branched and normal paraffins recovered from the isomerization product by molecular-sieve extraction.

Yields, product properties and operating conditions of other units remain as in Example 4. Overall yields, aromatics content and oxygen content of the gasoline component also do not change substantially, as the isomerization yield is essentially 100 volume %. Gasoline-component Research octane number is affected as follows, comparing once-through and recycle isomerization with the Example 4 blends:

| | No Isomerization | Once-Through Isomerization | Recycle Isomerization |
|---|---|---|---|
| Case A | 94.0 | 96.2 | 98.4 |
| Case B | 94.0 | 95.6 | 98.4 |
| Case C | 94.0 | 95.1 | 98.5 |
| Case D | 94.0 | 94.8 | 98.7 |
| Case E | 94.0 | 95.0 | 99.6 |

Thus, in all cases the isomerization option of the invention will enable production of increased yields of a gasoline component having exceptionally high octane and reduced aromatics content and containing oxygenates.

There are a range of options within the invention as illustrated in the cases of the examples to control gasoline-component octane number, aromatic content, distribution of light components and production of MTBE to use in outside gasoline blending. In any case, the invention provides an increased yield of a gasoline component which contains oxygenates and has a reduced aromatics content.

We claim as our invention:

1. A process combination for producing a gasoline component from a naphtha feedstock comprising the steps of:

(a) selectively synthesizing isoparaffins from the naphtha feedstock using a selective isoparaffin-synthesis catalyst at selective-isoparaffin-synthesis conditions in the presence of hydrogen to form a synthesis effluent with a higher isoparaffin/n-paraffin ratio than that of the naphtha feedstock;

(b) separating the synthesis effluent in a separation zone to obtain an isobutane-rich stream, a light naphtha and a reforming feed;

(c) dehydrogenating a first portion of the isobutane-rich stream in a dehydrogenation zone at dehydrogenation conditions using a dehydrogenation catalyst and recovering an isobutene-containing stream;

(d) contacting a first portion of the isobutene-containing stream with an alcohol in an etherification zone at etherification conditions to obtain an ether and a hydrocarbon raffinate;

(e) contacting a second portion of the isobutane-rich stream and a second portion of the isobutene-containing stream in an alkylation zone at alkylation conditions to obtain an alkylate;

(f) contacting the reforming feed in a reforming zone at reforming conditions using a reforming catalyst to obtain a reformate; and, (g) blending the gasoline component comprising at least a portion of each of the light naphtha, ether, alkylate and reformate.

2. The process combination of claim 1 wherein the alcohol of step (d) comprises methanol and the ether comprises methyl tertiary-butyl ether (MTBE).

3. The process combination of claim 1 wherein the first portion of the isobutane-rich stream of step (c) and the second portion of the isobutane-rich stream of step (e) comprise substantially all of the isobutane-rich stream.

4. The process combination of claim 1 wherein the first portion of the isobutene-containing stream of step (d) and the second portion of the isobutene-containing stream of step (e) comprise substantially all of the isobutene-containing stream.

5. The process combination of claim 1 wherein at least a portion of the light naphtha is contacted in an isomerization zone at isomerization conditions using an isomerization catalyst to obtain an isomerized light product.

6. The process combination of claim 5 wherein the gasoline component comprises at least a portion of the isomerized light product.

7. The process combination of claim 5 wherein step (f) further comprises separating the reformate in a reformate-separation zone into a light reformate and a heavy reformate, and contacting the light reformate in the isomerization zone to obtain supplemental isomerized light product.

8. The process combination of claim 1 wherein the light naphtha is separated in a second separation zone into a pentane-rich fraction and a hexane concentrate.

9. The process combination of claim 8 wherein the hexane concentrate is contacted in an isomerization zone to obtain an isohexane-rich fraction.

10. The process combination of claim 8 wherein at least a portion of the pentane-rich fraction is dehydrogenated in the dehydrogenation zone to obtain an isopentene-containing stream.

11. The process combination of claim 10 wherein at least a portion of the isopentene-containing stream is contacted with an alcohol in the etherification zone to obtain an ether.

12. The process combination of claim 10 wherein at least a portion of the isopentene-containing stream is contacted with the isobutane-rich stream in an alkylation zone at alkylation conditions to obtain a $C_5$ alkylate.

13. The process combination of claim 1 further comprising contacting the naphtha feedstock with an aromatics-saturation catalyst contained within the selective-isoparaffin-synthesis zone prior to the selective isoparaffin-synthesis catalyst.

14. The process combination of claim 1 further comprising recycling the hydrocarbon raffinate of step (d) to the dehydrogenation zone.

15. The process combination of claim 1 comprising blending substantially all of each of the light naphtha and reformate and a substantial portion of the ether to obtain a gasoline component having an oxygen content of at least 1.5 mass %, and having an aromatics content at least 10% lower than a reformate which has essentially the same octane number as the gasoline component and is produced from the naphtha feedstock at essentially the same reforming-zone pressure.

16. A process combination for producing a gasoline component from a naphtha feedstock comprising the steps of:

(a) selectively synthesizing isoparaffins from the naphtha feedstock using a selective isoparaffin-synthesis catalyst at selective-isoparaffin-synthesis conditions in the presence of hydrogen to form a synthesis effluent with a higher isoparaffin/n-paraffin ratio than that of the naphtha feedstock;

(b) separating the synthesis effluent in a separation zone to obtain an light liquid comprising isobutane and isopentane, a light naphtha comprising hexanes, and a reforming feed;

(c) dehydrogenating a first portion of the light liquid in a dehydrogenation zone at dehydrogenation conditions using a dehydrogenation catalyst and recovering an isoolefin-containing stream containing isobutene and isopentene;

(d) contacting a first portion of the isoolefin-containing stream with an alcohol in an etherification zone at etherification conditions to obtain an ether and a hydrocarbon raffinate;

(e) contacting a second portion of the light liquid and a second portion of the isoolefin-containing stream in an alkylation zone at alkylation conditions to obtain an alkylate;

(f) contacting the reforming feed in a reforming zone at reforming conditions using a reforming catalyst to obtain a reformate; and, (g) blending the gasoline component comprising at least a portion of each of the light naphtha, ether, alkylate and reformate.

17. The process combination of claim 16 wherein at least a portion of the light naphtha is contacted in an isomerization zone at isomerization conditions using an isomerization catalyst to obtain an isomerized light product.

18. A process combination for producing a gasoline component from a naphtha feedstock comprising the steps of:

(a) selectively synthesizing isoparaffins from the naphtha feedstock using a selective isoparaffin-synthesis catalyst at selective-isoparaffin-synthesis conditions in the presence of hydrogen to form a synthesis effluent with a higher isoparaffin/n-paraffin ratio than that of the naphtha feedstock;

(b) separating the synthesis effluent in a separation zone to obtain an isobutane-rich stream, a light naphtha and a reforming feed;

(c) dehydrogenating a first portion of the isobutane-rich stream and of a hydrocarbon raffinate in a dehydrogenation zone at dehydrogenation conditions using a dehydrogenation catalyst and recovering an isobutene-containing stream;

(d) contacting a first portion of the isobutene-containing stream with an alcohol in an etherification zone at etherification conditions to obtain an ether and a hydrocarbon raffinate;

(e) contacting a second portion of the isobutane-rich stream and hydrocarbon raffinate and a second portion of the isobutene-containing stream in an alkylation zone at alkylation conditions to obtain an alkylate;

(f) contacting the reforming feed in a reforming zone at reforming conditions using a reforming catalyst to obtain a reformate;

(g) contacting the light naphtha in an isomerization zone at isomerization conditions using an isomerization catalyst to obtain an isomerized light product; and (h) blending the gasoline component comprising at least a portion of each of the isomerized light product, MTBE, alkylate and reformate.

19. The process combination of claim 18 comprising blending substantially all of each of the isomerized light product, reformate and alkylate and a substantial portion of the ether to obtain a gasoline component having an oxygen content of at least 1.5 mass %, and having an aromatics content at least 10% lower than a reformate having essentially the same octane number as the gasoline component and produced from the naphtha feedstock at essentially the same reforming-zone pressure.

* * * * *